US010415438B2

(12) United States Patent
Bang

(10) Patent No.: US 10,415,438 B2
(45) Date of Patent: Sep. 17, 2019

(54) OIL DRAIN PREVENTING DEVICE FOR CONTINUOUSLY VARIABLE VALVE TIMING APPARATUS

(71) Applicants: Hyundai Motor Company, Seoul (KR); Kia Motors Corporation, Seoul (KR)

(72) Inventor: Sang Hyun Bang, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 15/834,684

(22) Filed: Dec. 7, 2017

(65) Prior Publication Data

US 2019/0072008 A1 Mar. 7, 2019

(30) Foreign Application Priority Data

Sep. 7, 2017 (KR) ..... 10-2017-0114571

(51) Int. Cl.
*F01L 1/344* (2006.01)
*F01L 1/053* (2006.01)

(52) U.S. Cl.
CPC ..... *F01L 1/3442* (2013.01); *F01L 1/344* (2013.01); *F01L 2001/0537* (2013.01); *F01L 2001/34423* (2013.01); *F01L 2001/34426* (2013.01); *F01L 2001/34479* (2013.01); *F01L 2001/34496* (2013.01); *F01L 2800/01* (2013.01); *F01L 2800/03* (2013.01)

(58) Field of Classification Search
CPC ... F01L 2001/34426; F01L 1/46; F01L 13/04; F01L 2800/01; F01L 2800/03
USPC ..... 123/90.12, 90.15
See application file for complete search history.

(56) References Cited

U.S. PATENT DOCUMENTS 6,820,578 B2 * 11/2004 Kanada ..... F01L 1/34 123/90.15
2007/0028874 A1 * 2/2007 Simpson ..... F01L 1/022 123/90.15

FOREIGN PATENT DOCUMENTS

| | | | |
|---|---|---|---|
| JP | 11-013430 | A | 1/1999 |
| JP | 5522203 | B2 | 6/2014 |
| KR | 10-1250676 | B1 | 4/2013 |
| KR | 10-2013-0028333 | A | 5/2013 |

* cited by examiner

*Primary Examiner* — Jorge L Leon, Jr.
(74) *Attorney, Agent, or Firm* — Mintz Levin Cohn Ferris Glovsky and Popeo, P.C.; Peter F. Corless

(57) ABSTRACT

An oil drain preventing device for a continuously variable valve timing apparatus includes: an advance angle oil passage connected to a continuously variable valve timing (CVVT) journal from an an oil control valve (OCV) groove to which an oil control valve (OCV) is mounted to supply an oil supplied from a hydraulic pump to a continuously variable valve timing (CVVT) apparatus; a retard angle oil passage connected to the CVVT journal from the OCV groove; and a valve unit mounted to the advance angle oil passage and the retard angle oil passage between the oil control valve and the CVVT journal for preventing the oil supplied to the continuously variable valve timing apparatus from being drained by selectively opening/closing the advance angle oil passage and the retard angle oil passage according to a starting ON or a starting OFF of the engine.

13 Claims, 6 Drawing Sheets

OIL DRAIN PREVENTING DEVICE FOR CONTINUOUSLY VARIABLE VALVE TIMING APPARATUS

CROSS-REFERENCE TO RELATED APPLICATION

This application claims under 35 U.S.C. § 119(a) the benefit of Korean Patent Application No. 10-2017-0114571 filed in the Korean Intellectual Property Office on Sep. 7, 2017, the entire contents of which are incorporated herein by reference.

BACKGROUND

(a) Technical Field

The present disclosure relates to an oil drain preventing device for a continuously variable valve timing apparatus, more particularly, to an oil drain preventing device for preventing oil supplied through each oil passage connected to an advance angle chamber and a retard angle chamber from being drained during a starting OFF of an engine.

(b) Description of the Related Art

An internal combustion engine generates power by burning fuel in a combustion chamber in air media drawn into the combustion chamber. In this case, when air is drawn in, an intake valve is operated by driving a camshaft, to draw the air into the combustion chamber while the intake valve is opened. When the air is exhausted, an exhaust valve is operated by driving the camshaft, and the air is exhausted from the combustion chamber while the exhaust valve is opened.

An optimum operation of the intake valve or the exhaust valve varies depending on a rotation speed of the engine. That is, depending on the rotation speed of the engine, an appropriate lift or valve opening/closing time is controlled.

In order to achieve such an optimal valve operation depending on the rotation speed of the engine, research has been undertaken on a continuously variable valve timing (CVVT) apparatus that enables different valve timing operations depending on the engine speed.

Typically, such a CVVT apparatus is operated by hydraulic pressure generated by a hydraulic pump when the engine is running Since oil has incompressibility, it is appropriate as a medium for operating various components. In addition, lubrication, cleaning, and cooling of moving components may be achieved by oil.

However, in the conventional CVVT apparatus, if the starting of the engine is turned off, the oil supplied to the advance angle chamber and the retard angle chamber is continuously drained through each oil passage. In this state, if the starting of the engine is turned on, in order to again operate the CVVT apparatus, the drained oil must be filled in the advance angle chamber and the retard angle chamber.

Therefore, in the conventional art, a time required to operate the CVVT apparatus increases by a time required for the oil filling. In addition, as the CVVT operation time increases, it is likely that the response time of the vehicle will be undesirably lengthened.

Also, in the conventional art, as an oil consumption amount depending on the operation of the CVVT increases, a capacity of a hydraulic pump increases, thus producing a disadvantageous result for fuel consumption and exhaust gas reduction.

The above information disclosed in this Background section is only for enhancement of understanding of the background of the disclosure and therefore it may contain information that does not form the prior art that is already known in this country to a person of ordinary skill in the art.

SUMMARY

Accordingly, the present disclosure provides an oil drain preventing device for a continuously variable valve timing apparatus preventing an oil supplied through each oil passage connected to an advance angle chamber and a retard angle chamber from being drained during a starting OFF of an engine to reduce an oil filling time during an engine restarting, thereby improving an operation performance of the continuously variable valve timing apparatus and reducing the fuel consumption and the exhaust gas.

An oil drain preventing device for a continuously variable valve timing apparatus according to an exemplary embodiment of the present disclosure includes An advance angle oil passage connected to a continuously variable valve timing (CVVT) journal from an oil control valve (OCV) groove to which an oil control valve (OCV) is mounted to supply an oil supplied from a hydraulic pump to a continuously variable valve timing (CVVT) apparatus; a retard angle oil passage connected to the CVVT journal from the OCV groove; and a valve unit mounted to the advance angle oil passage and the retard angle oil passage between the oil control valve and the CVVT journal for preventing the oil supplied to the continuously variable valve timing apparatus from being drained by selectively opening/closing the advance angle oil passage and the retard angle oil passage according to a starting ON or a starting OFF of the engine.

The valve unit may include a valve housing having one end that is closed and another end that is opened and formed with a penetration hole in a vertical direction at one side in a length direction so that the advance angle oil passage or the retard angle oil passage is connected; an operation plunger having an oil groove formed on an exterior circumference by corresponding to the penetration hole and mounted to be slidingly moveable along the length direction inside the valve housing; a mounting cap mounted to the opened end of the valve housing to prevent a withdraw of the operation plunger from the valve housing; and an elastic member interposed between the operation plunger and the mounting cap and providing an elastic force to the operation plunger.

An inflow hole connected the hydraulic pump through a supply oil passage and inflowing an oil inside the valve housing may be formed at the closed end of the valve housing.

If the oil is supplied to the valve housing, the operation plunger may be slidingly moved toward the mounting cap to position the oil groove at the penetration hole so to open the penetration hole.

If the oil supply is stopped to the valve housing, the operation plunger may be slidingly moved to the closed end of the valve housing by the elastic member to close the penetration hole that is opened by the oil groove.

The oil groove may be formed to be concave in a hemisphere shape along an exterior circumference of the operation plunger.

The elastic member may be a coil spring of which one end is supported to the operation plunger and the other end is supported to the mounting cap.

The valve unit may be respectively provided on the advance angle oil passage and the retard angle oil passage inside the cylinder head.

The valve unit may include a valve housing having one end that is closed and another end that is opened and first and second penetration holes respectively formed in a vertical direction at positions separated with a predetermined interval along a length direction so that the advance angle oil passage and the retard angle oil passage are connected; a operation plunger having first and second oil grooves respectively formed corresponding to the first and second penetration holes at separated positions on the exterior circumference and mounted to be slidingly moveable along the length direction inside the valve housing; a mounting cap mounted at the opened end of the valve housing to prevent a withdraw of the operation plunger from the valve housing; and an elastic member interposed between the operation plunger and the mounting cap and providing an elastic force to the operation plunger.

An inflow hole connected to the hydraulic pump through a supply oil passage and inflowing an oil inside the valve housing may be formed at the closed end of the valve housing.

If the oil is supplied to the valve housing, the operation plunger may be slidingly moved toward the mounting cap to respectively position the first and second oil grooves at the first and second penetration hole so that the first and second penetration holes are opened.

If the oil supply is stopped to the valve housing, the operation plunger is slidingly moved to the closed end of the valve housing by the elastic member to close the first and second penetration hole that is opened by the first and second oil grooves.

The first and second oil grooves may be formed to be concave in a hemisphere shape along an exterior circumference at positions separated in the length direction of the operation plunger.

The valve housing may be provided so that the advance angle oil passage is positioned at the first penetration hole and the retard angle oil passage is positioned at the second penetration hole inside the cylinder head.

According to the oil drain preventing device for the continuously variable valve timing apparatus according to an exemplary embodiment of the present disclosure, as the oil supplied through each oil passage connected to the advance angle chamber and the retard angle chamber is prevented from being drained during the starting OFF of the engine, an oil filling time is reduced during a restarting of the engine, thereby improving a responsiveness and an operation performance of the continuously variable valve timing apparatus.

Also, an operation of the continuously variable valve timing apparatus (CVVT apparatus) is possible directly from the starting of the engine, improvement of fuel consumption and reduction of exhaust gas may be achieved.

Further, power performance of the vehicle may be improved by the operation of the continuously variable valve timing apparatus directly after the starting of the engine.

DETAILED DESCRIPTION OF THE EMBODIMENTS

Figure 1:
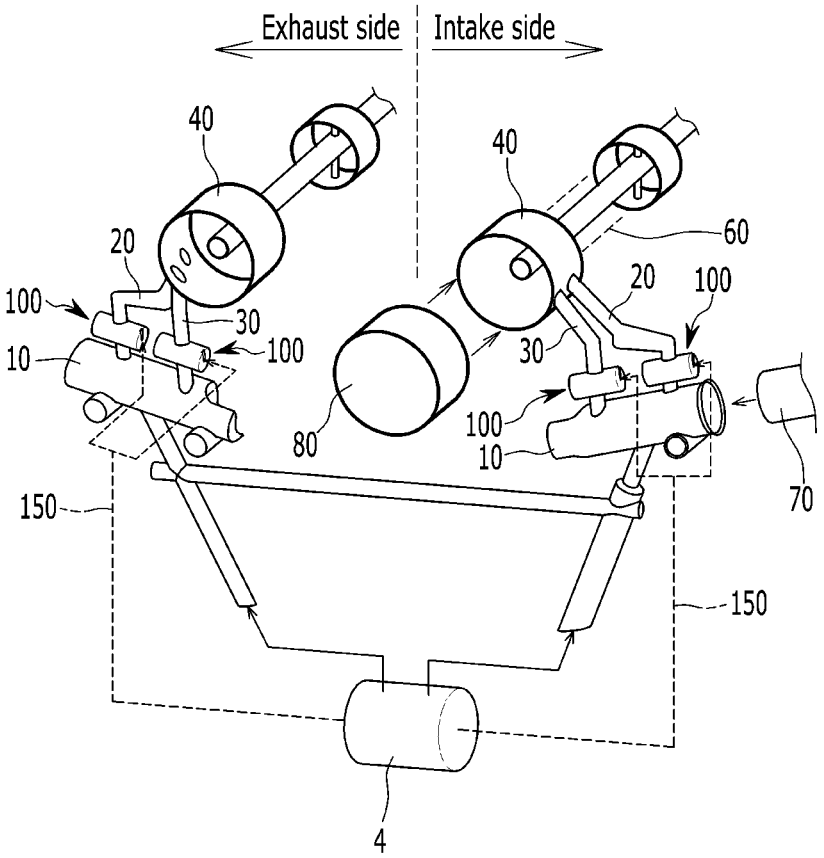
FIG. 1 is a schematic diagram of an oil gallery to which an oil drain preventing device for a continuously variable valve timing apparatus is applied according to an exemplary embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

An exemplary embodiment of the present disclosure will hereinafter be described in detail with reference to the accompanying drawings.

The embodiment described in the present specification and the configuration shown in the drawings are merely an exemplary embodiment of the present disclosure and do not represent all of the technical spirit of the present disclosure. Thus, it should be understood that there may be various equivalents and modified examples that can replace the embodiments described in the present specification and the configuration shown in the drawings at the time of filling the present application.

The unrelated parts to the description of the exemplary embodiments are not shown to make the description clear and like reference numerals designate like element throughout the specification.

Figure 2:
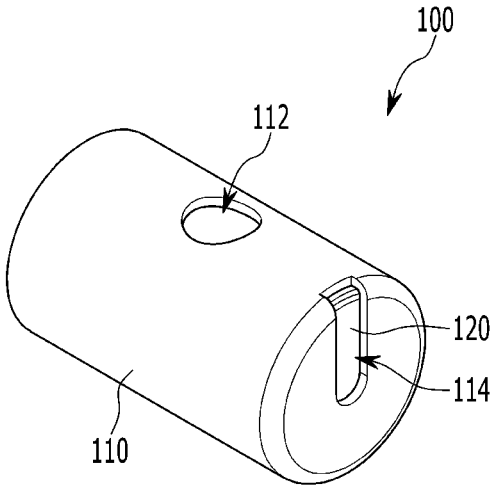
FIG. 2 is a perspective view of an oil drain preventing device for a continuously variable valve timing apparatus according to an exemplary embodiment of the present disclosure.
Figure 3:
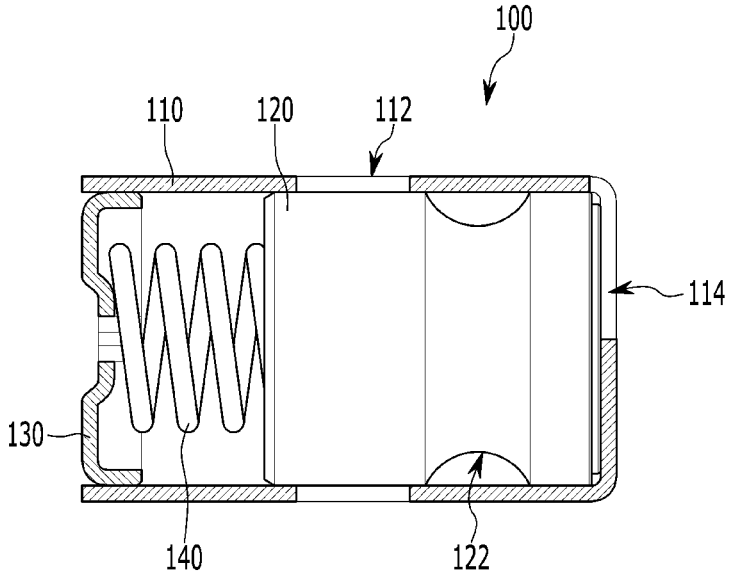
FIG. 3 is a cross-sectional view of an oil drain preventing device for a continuously variable valve timing apparatus according to an exemplary embodiment of the present disclosure.

FIG. 1 is a schematic diagram of an oil gallery to which an oil drain preventing device for a continuously variable valve timing apparatus is applied according to an exemplary embodiment of the present disclosure, FIG. 2 is a perspective view of an oil drain preventing device for a continuously variable valve timing apparatus according to an exemplary embodiment of the present disclosure, and FIG. 3 is a cross-sectional view of an oil drain preventing device for a continuously variable valve timing apparatus according to an exemplary embodiment of the present disclosure.

An oil gallery connected to a continuously variable valve timing (hereinafter, referred to as "CVVT") apparatus 80 according to an exemplary embodiment of the present disclosure will be described with reference to FIG. 1.

FIG. 1 shows a configuration of the oil gallery connected to the CVVT apparatus respectively formed at an exhaust side and an intake side as an example. These exhaust side and intake side oil galleries may be arranged symmetrically.

Typically, a CVVT apparatus 80 receives hydraulic pressure from a hydraulic pump 4 of an engine, and is operated by the hydraulic pressure. Therefore, an oil passage (the oil gallery) for delivering oil from the hydraulic pump 4 to the CVVT apparatus 80 is formed at a cylinder block (not shown) and the cylinder head 2. An oil control valve (OCV) 70 for controlling an oil supply to the CVVT apparatus 80 is arranged at a midway point of the oil gallery for a CVVT apparatus formed in the cylinder head.

That is, according to an exemplary embodiment of the present disclosure, an advance oil supply passage 20 and a retard oil supply passage 30 are formed from an OCV groove 10 where the OCV 70 is inserted to a camshaft journal (hereinafter referred to as a CVVT journal) 40 where the CVVT apparatus 80 is mounted.

The CVVT apparatus 80 receives the oil through the CVVT journal 40 from the advance oil supply passage 20 or the retard oil supply passage 30, and then advances or retards an angle of the camshaft 60.

To advance or to retard the cam angle is controlled by the OCV 70 by selectively supplying the oil through one oil supply passage of the advance oil supply passage 20 and the retard oil supply passage 30.

Here, the oil drain preventing device according to an exemplary embodiment of the present disclosure further includes a valve unit 100 mounted to the advance angle oil passage 20 and the retard angle oil passage 30 between the OCV 70 and the CVVT journal 40 for preventing the oil supplied to the CVVT apparatus 80 from being drained by selectively opening/closing the advance angle oil passage 20 and the retard angle oil passage 30 according to a starting ON or a starting OFF of the engine.

The valve unit 100 may be respectively provided on the advance angle oil passage 20 and the retard angle oil passage 30 inside the cylinder head 2.

As shown in FIG. 2 and FIG. 3, the valve unit 100 includes a valve housing 110, an operation plunger 120, a mounting cap 130, and an elastic member 140.

First, the valve housing 110 is formed of a cylinder shape in which one end is closed and another end is opened.

In the valve housing 110, a penetration hole 112 in a vertical direction is formed at one side in a length direction so that the advance angle oil passage 20 or the retard angle oil passage 30 is connected thereto.

The penetration hole 112 may be formed in a diameter that is equal to or larger than the diameter of the advance angle oil passage 20, or the retard angle oil passage 30. Also, the penetration hole 112 may be home-positioned at the advance angle oil passage 20 or the retard angle oil passage 30 when mounting the valve housing 110 to the cylinder head 2.

An inflow hole 114 connected to the hydraulic pump 4 through the supply oil passage 150 is formed at the closed end of the valve housing 110. The inflow hole 114 may inflow the oil to the inside of the valve housing 150.

The inflow hole 114 may be formed of a slot shape in which the inflow hole 114 is connected from an upper part to a center part of the valve housing 110.

In the present exemplary embodiment, the operation plunger 120 is mounted to be slidingly moveable along the length direction inside the valve housing 110. In the operation plunger 120, an oil groove 122 is formed corresponding to the penetration hole 112 on an exterior circumference.

The oil groove 122 may be formed to be concave in a hemisphere shape along the exterior circumference of the operation plunger 120.

The operation plunger 120 may be mounted to be slidingly moveable along the length direction inside the valve housing 110 when the oil inflows into the valve housing 110 through the inflow hole 114.

In the present exemplary embodiment, the mounting cap 130 is mounted to the opened end of the valve housing 110 so as to prevent withdrawal of the operation plunger 120 from the valve housing 110.

Also, the elastic member 140 is interposed between the operation plunger 120 and the mounting cap 130 and provides an elastic force to the operation plunger 120.

Here, the elastic member 140 may be a coil spring having one end supported to the operation plunger 120 and another end supported to the mounting cap 130.

The elastic member 140 is compressed by the operation plunger 120 moved toward the mounting cap 130 if the oil is supplied to the valve housing 110.

In this state, the oil supply is stopped to the valve housing 110, while the compression of the elastic member 140 is canceled, the elastic force is provided to the operation plunger 120 such that the operation plunger 120 is recovered to an initial position.

Next, the operation and the action of the oil drain preventing device according to an exemplary embodiment of the present disclosure will be described in detail.

Figure 4:
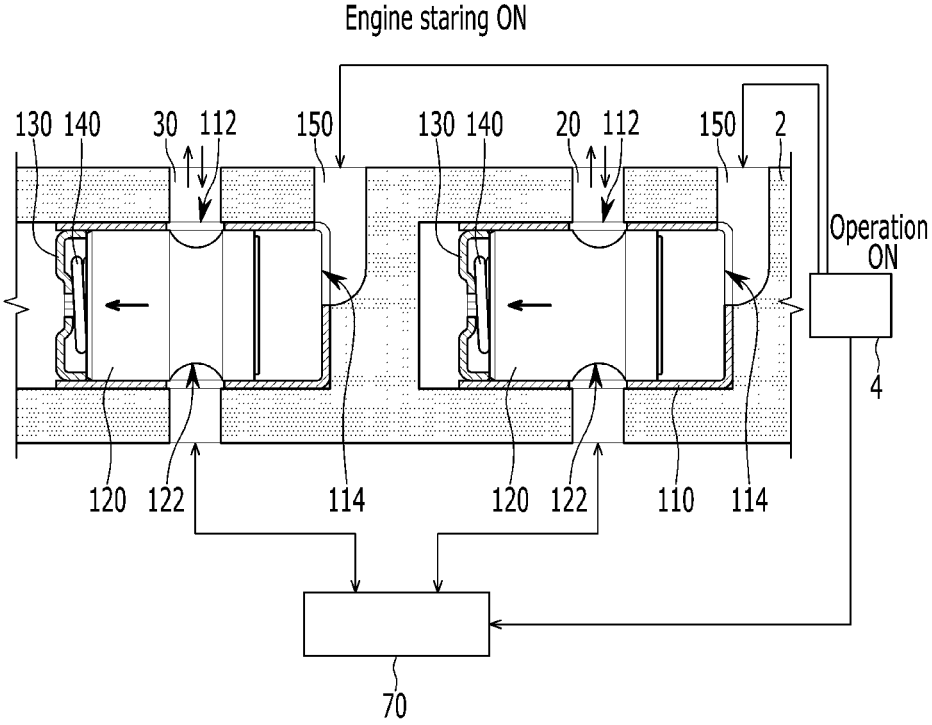
FIG. 4 and FIG. 5 are diagrams of an operation of an oil drain preventing device for a continuously variable valve timing apparatus according to an exemplary embodiment of the present disclosure.
Figure 5:
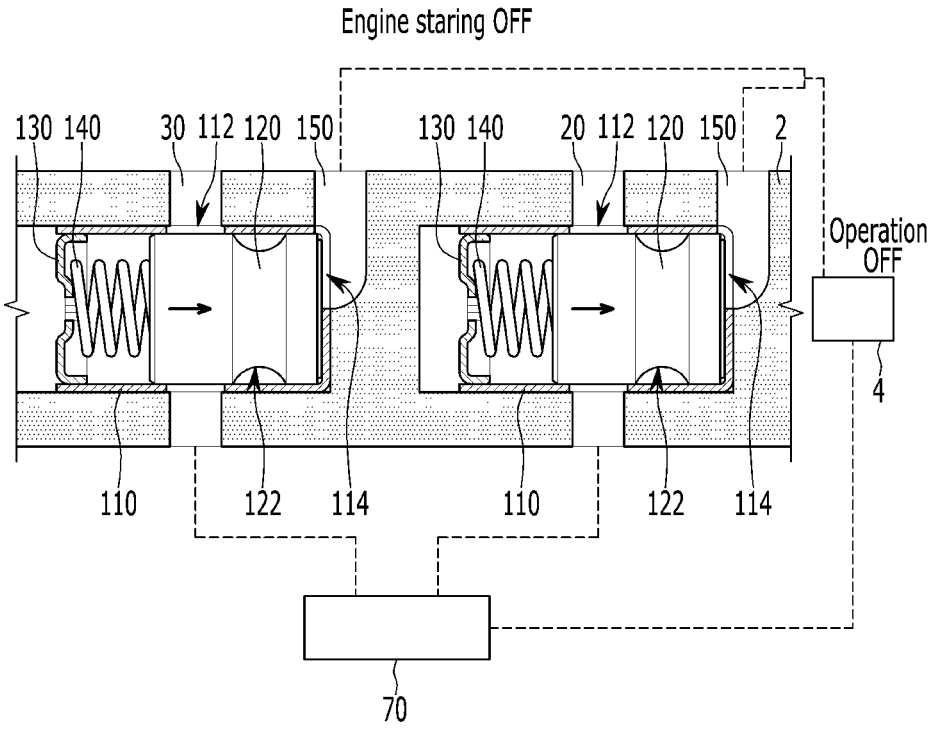

FIG. 4 and FIG. 5 are diagrams of an operation of an oil drain preventing device for a continuously variable valve timing apparatus according to an exemplary embodiment of the present disclosure.

Referring to FIG. 4, in the oil drain preventing device according to the present exemplary embodiment, the state that the advance angle oil passage 20 and the retard angle oil passage 30 are opened through the operation of the valve unit 100 will be described.

First, if the starting of the engine is turned on, while the hydraulic pump 4 is operated, the oil is supplied to the OCV 70 and the supply oil passage 150, respectively. Thus, the oil supplied to the supply oil passage 150 inflows to the valve housing 110 through the inflow hole 114.

The operation plunger 120 slidingly moves toward the mounting cap 130 by the oil inflowing to the valve housing 110, and the elastic member 140 is compressed by the slidingly moved operation plunger 120.

If the sliding movement of the operation plunger 120 is completed, as the oil groove 122 is home-positioned to the penetration hole 112, the penetration hole 112 is opened.

Accordingly, the advance angle oil passage 20 and the retard angle oil passage 30 are respectively opened, as the oil supply is controlled through the OCV 70, the oil is circulated along the advance angle oil passage 20 and retard angle oil passage 30.

Thus, while the oil circulated along the advance angle and retard angle oil passages 20 and 30 is selectively supplied or exhausted to the advance angle chamber or the retard angle chamber provided at the CVVT apparatus 80 by the control of the OCV 70, the CVVT apparatus 80 may be operated.

In this state, if the starting of the engine is turned off, as shown in FIG. 5, the operation of the hydraulic pump 4 is turned off. Thus, the oil supply is stopped to the OCV 70 and the supply oil passage 150.

In this case, as the oil supply is stopped to the valve unit 100, the operation plunger 120 slidingly moves to the inflow hole 114 by the elastic force that the elastic member 140 that was compressed.

Thus, the oil groove 122 is withdrawn from the penetration hole 112, the operation plunger 120 closes the penetration hole 112 to close the advance angle oil passage 20 and the retard angle oil passage 30.

Accordingly, with respect to the valve unit 100, the drain of the circulated oil is prevented in the advance angle oil passage 20 and the retard angle oil passage 30, the CVVT journal 40, and the advance angle chamber and the retard angle chamber of the CVVT apparatus 80, the state that oil is filled is maintained.

In this state, if the starting of the engine is turned on, while the hydraulic pump 4 is again operated, the oil is supplied to the OCV 70 and the supply oil passage 150.

Thus, the operation plunger 120 again opens the penetration hole 112 that is operated like FIG. 4 to be closed. Simultaneously, the oil supplied from the OCV 70 may operate the CVVT apparatus 80 while quickly being circulated along the advance angle oil passage 20 and the retard angle oil passage 30.

That is, the oil circulating between the advance angle oil passage 20 and the retard angle oil passage 30 from the CVVT apparatus 80 is prevented from being drained to an oil pan through the valve unit 100 operated according to the starting ON or the starting OFF of the engine and remains in each oil passage.

Accordingly, the oil drain preventing device may reduce the time consumed for the oil filling for the operation of the CVVT apparatus 80 during the starting ON of the engine, and the operation time of the CVVT apparatus 80 may be reduced.

Figure 6:
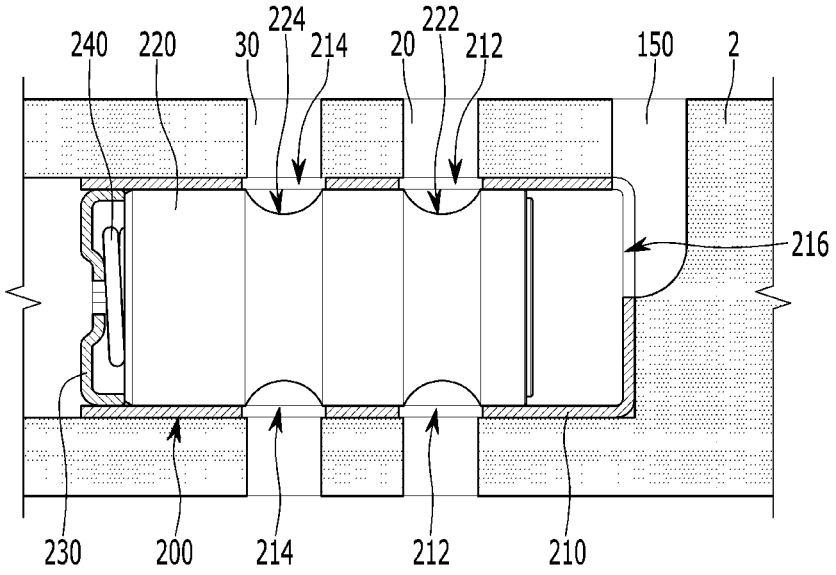
FIG. 6 is a schematic diagram of an oil drain preventing device for a continuously variable valve timing apparatus according to another exemplary embodiment of the present disclosure.

FIG. 6 is a schematic diagram of an oil drain preventing device for a continuously variable valve timing apparatus according to another exemplary embodiment of the present disclosure.

Referring to FIG. 6, the oil drain preventing device for the continuously variable valve timing apparatus according to another exemplary embodiment of the present disclosure further includes a valve unit 200 mounted to the advance angle oil passage 20 and the retard angle oil passage 30 for preventing the oil supplied to the CVVT apparatus 80 from being drained by selectively opening/closing the advance angle oil passage 20 and the retard angle oil passage 30 according to the starting ON or the starting OFF of the engine.

In particular, one valve unit 200 may be provided corresponding to the advance angle oil passage 20 and the retard angle oil passage 30 inside the cylinder head 2.

As shown in FIG. 6, the valve unit 200 includes a valve housing 210, an operation plunger 220, a mounting cap 230, and an elastic member 240.

First, the valve housing 210 is formed of the cylinder shape in which one end is closed and another is opened.

In the valve housing 210, first and second penetration holes 212 and 214 are respectively formed in the vertical direction at positions separated with a predetermined interval along the length direction so that the advance angle oil passage 20 and the retard angle oil passage 30 are respectively connected thereto.

That is, the valve unit 200 may be provided so that the advance angle oil passage 20 is positioned at the first penetration hole 212 and the retard angle oil passage 30 is positioned at the second penetration hole 214 inside the cylinder head 2.

The first and second penetration holes 212 and 214 may be formed in the diameter that is equal to or larger than the diameter of the advance angle and retard angle oil passages 20 and 30. Also, when mounting the valve housing 210 to the cylinder head 2, the first and second penetration hole 212 and 214 may be home-positioned at the advance angle and retard angle oil passages 20 and 30.

An inflow hole 216 connected to the hydraulic pump 4 through the supply oil passage 150 is formed at the closed end of the valve housing 210. The inflow hole 216 may inflow the oil to the inside of the valve housing 150.

The inflow hole 216 may be formed of a slot shape in which the inflow hole 216 is continuous from the upper part to the center part of the valve housing 210.

In the present exemplary embodiment, the operation plunger 220 is mounted to be slidingly moveable along the length direction inside the valve housing 210. In the operation plunger 220, first and second oil grooves 222 and 224 are respectively formed corresponding to the first and second penetration holes 212 and 214 at separated positions on the exterior circumference.

The first and second oil grooves 222 and 224 may be formed to be concave in the hemisphere shape along the exterior circumference at the separated positions in the length direction of the operation plunger 220.

The operation plunger 220 may be mounted to be slidingly moveable along the length direction inside the valve housing 210 when the oil inflows to the valve housing 210 through the inflow hole 216.

The mounting cap 230 is mounted to the opened end of the valve housing 210 to prevent the withdrawal of the operation plunger 220 from the valve housing 210.

Also, the elastic member 240 is interposed between the operation plunger 220 and the mounting cap 230 and provides the elastic force to the operation plunger 220.

In particular, the elastic member 240 may be the coil spring having one end supported to the operation plunger 220 and another end supported to the mounting cap 230.

The elastic member 240 is compressed by the operation plunger 220 moved toward the mounting cap 230 if the oil is supplied to the valve housing 210.

In this state, the oil supply is stopped to the valve housing 210, while the compression of the elastic member 240 is canceled, the elastic force is provided to the operation plunger 220 such that the operation plunger 220 is recovered to an initial position.

The operation plunger 220 slidingly moves toward the mounting cap 130 if the oil is supplied to the valve housing 210. Accordingly, as the first and second oil grooves 222 and 224 are respectively home-positioned at the first and second penetration holes 212 and 214, the first and second penetration holes 212 and 214 are opened.

Accordingly, as the advance angle oil passage 20 and the retard angle oil passage 30 are respectively opened and the supply of the oil is controlled through the OCV 70, the oil is circulated along the advance angle oil passage 20 and the retard angle oil passage 30.

In contrast, if the starting of the engine is turned off, the operation of the hydraulic pump 4 is turned off, the oil supply is stopped to the OCV 70 and the supply oil passage 150.

In this case, the operation plunger 220 receives the elastic force from the elastic member 240 that was compressed and slidingly moves to the closed end of the valve housing 210.

Thus, the first and second penetration holes 212 and 214 that are opened by the first and second oil grooves 222 and 224 are closed.

That is, in another exemplary embodiment of the present disclosure, the advance angle and retard angle oil passages 20 and 30 may be all selectively opened/closed by one valve unit 200 according to the starting ON or OFF of the engine.

Accordingly, if the oil drain preventing device for the continuously variable valve timing apparatus according to an exemplary embodiment of the present disclosure configured above is applied, as the oil supplied through the advance angle and retard angle oil passages 20 and 30 connected to the advance angle chamber and the retard angle chamber is prevented from being drained during the starting OFF of the engine, the oil filling time for the operation of the CVVT apparatus 80 may be reduced during the restarting of the engine, thereby improving responsiveness and operation performance of the CVVT apparatus 80.

Also, as the operation of the CVVT apparatus 80 directly after the starting of the engine is possible, the improvement of fuel consumption and the reduction of exhaust gas may result.

Further, a power performance of a vehicle may be improved due to the operation of the CVVT apparatus 80 directly after the starting of the engine.

While this disclosure has been described in connection with what is presently considered to be practical exemplary embodiments, it is to be understood that the disclosure is not limited to the disclosed embodiments, but, on the contrary, is intended to cover various modifications and equivalent arrangements included within the spirit and scope of the appended claims.

What is claimed is:

1. An oil drain preventing device for a continuously variable valve timing (CVVT) apparatus, the oil drain preventing device comprising:

an advance angle oil passage connected to a CVVT journal from an oil control valve (OCV) groove to which an oil control valve (OCV) is mounted to supply oil from a hydraulic pump to the CVVT apparatus;

a retard angle oil passage connected to the CVVT journal from the OCV groove; and a valve unit mounted to the advance angle oil passage and the retard angle oil passage between the OCV and the CVVT journal for preventing the oil supplied to the CVVT apparatus from being drained by selectively opening/closing the advance angle oil passage and the retard angle oil passage according to an engine ON or OFF condition, wherein the valve unit includes:

a valve housing having a closed end and an opened end, the valve housing further including a penetration hole formed as a through-hole in a radial direction with respect to a longitudinal direction of the valve housing so that the advance angle oil passage or the retard angle oil passage is fluidly connected to the hydraulic pump via the penetration hole;

an operation plunger having an oil groove formed on an exterior circumference of the operation plunger corresponding to the penetration hole, the operation plunger mounted to be slidingly moveable along the longitudinal direction inside the valve housing;

a mounting cap mounted to the opened end of the valve housing to prevent a withdrawal of the operation plunger from the valve housing; and an elastic member interposed between the operation plunger and the mounting cap and providing an elastic force to the operation plunger.

2. The oil drain preventing device of claim 1, wherein:

an inflow hole is formed at the closed end of the valve housing, the inflow hole is connected to the hydraulic pump through a supply oil passage such that the oil is supplied to the valve housing through the inflow hole.

3. The oil drain preventing device of claim 2, wherein:

when the oil is supplied to the valve housing, the operation plunger is slidingly moved toward the mounting cap to position the oil groove at the penetration hole so as to open the penetration hole to the oil groove.

4. The oil drain preventing device of claim 2, wherein:

when the oil supplied to the valve housing is stopped, the operation plunger is slidingly moved to the closed end of the valve housing by the elastic member to close the penetration hole from the oil groove.

5. The oil drain preventing device of claim 1, wherein:

the oil groove is formed to be concave in a hemisphere shape along the exterior circumference of the operation plunger.

6. The oil drain preventing device of claim 1, wherein:

the elastic member is a coil spring of which one end is supported by the operation plunger and another end is supported by the mounting cap.

7. The oil drain preventing device of claim 1, wherein:

the valve unit includes first and second valve units respectively provided on the advance angle oil passage and the retard angle oil passage inside a cylinder head.

8. An oil drain preventing device for a continuously variable valve timing (CVVT) apparatus, the oil drain preventing device comprising:

an advance angle oil passage connected to a CVVT journal from an oil control valve (OCV) groove to which an oil control valve (OCV) is mounted to supply oil from a hydraulic pump to the CVVT apparatus;

a retard angle oil passage connected to the CVVT journal from the OCV groove; and a valve unit mounted to the advance angle oil passage and the retard angle oil passage between the OCV and the CVVT journal for preventing the oil supplied to the CVVT apparatus from being drained by selectively opening/closing the advance angle oil passage and the retard angle oil passage according to an engine ON or OFF condition, wherein the valve unit includes:

a valve housing having a closed end and an opened end, the valve housing further including first and second penetration holes each formed as a through-hole in a radial direction with respect to a longitudinal direction of the valve housing, the first and second penetration holes are separated from each other with a predetermined interval along the longitudinal direction so that the advance angle oil passage and the retard angle oil passage are fluidly connected to the hydraulic pump via the first and second penetration holes, respectively;

an operation plunger having first and second oil grooves formed on an exterior circumference of the operation plunger, the first and second oil grooves corresponding to the first and second penetration holes, respectively, at separated positions on the exterior circumference, the operation plunger mounted to be slidingly moveable along the longitudinal direction inside the valve housing;

a mounting cap mounted at the opened end of the valve housing to prevent a withdrawal of the operation plunger from the valve housing; and an elastic member interposed between the operation plunger and the mounting cap and providing an elastic force to the operation plunger.

9. The oil drain preventing device of claim 8, wherein:

an inflow hole is formed at the closed end of the valve housing, the inflow hole is connected to the hydraulic pump through a supply oil passage such that the oil is supplied to the valve housing through the inflow hole.

10. The oil drain preventing device of claim 9, wherein:

when the oil is supplied to the valve housing, the operation plunger is slidingly moved toward the mounting cap to respectively position the first and second oil grooves at the first and second penetration holes so that the first and second penetration holes are opened to the first and second oil grooves, respectively.

11. The oil drain preventing device of claim 9, wherein:

when the oil supplied to the valve housing is stopped, the operation plunger is slidingly moved to the closed end of the valve housing by the elastic member to close the first and second penetration holes from the first and second oil grooves.

12. The oil drain preventing device of claim 8, wherein:

the first and second oil grooves are formed to be concave in a hemisphere shape along the exterior circumference at positions separated in the longitudinal direction of the operation plunger.

13. The oil drain preventing device of claim 8, wherein:

the valve housing is provided so that the advance angle oil passage is positioned at the first penetration hole and the retard angle oil passage is positioned at the second penetration hole inside a cylinder head.

* * * * *